US005398393A

United States Patent [19]

Bentschneider

[11] Patent Number: 5,398,393

[45] Date of Patent: Mar. 21, 1995

[54] SEAT CUSHION AND COVER ASSEMBLY APPARATUS

[75] Inventor: Stephen E. Bentschneider, Jerome, Mich.

[73] Assignee: Labor Aiding Systems, Inc., Jackson, Mich.

[21] Appl. No.: 202,456

[22] Filed: Feb. 28, 1994

[51] Int. Cl.[6] ..... B68G 7/05

[52] U.S. Cl. ..... 29/91.5; 29/448; 29/281.4

[58] Field of Search ..... 29/91.1, 91.5, 91.6–91.8, 29/448, 281.1, 281.4

[56] References Cited

U.S. PATENT DOCUMENTS

| | | | |
|---|---|---|---|
| 3,438,108 | 4/1969 | Nash | 29/91.5 |
| 4,675,962 | 6/1987 | Tillner et al. | 29/91.5 X |
| 5,287,610 | 2/1994 | Gomolak et al. | 29/91.5 X |

*Primary Examiner*—Tom Hughes

*Attorney, Agent, or Firm*—Beaman & Beaman

[57] ABSTRACT

Assembly apparatus for assembling a compressible foam cushion and a flexible cover having favorable ergonomic characteristics. The apparatus includes a plate supporting the inverted cushion top having a flexible cover preliminarily positioned thereto, and a second plate engages the inverted cover bottom. A linear motor raises and lowers the second plate to selectively compress the cushion, and cover engaging rollers lift the cover adjacent the cushion sides during cushion compression to permit the cover to be attached to the cushion bottom. The cover engaging rollers are operated by a linear motor and are adjustable transverse to the direction of cushion compression to permit accommodation of various cushion configurations, and the cushion supporting plates are rotatable by a motor and selectively restrained against rotation by a brake to permit all sides of the cushion to be enclosed by the cover.

16 Claims, 3 Drawing Sheets

SEAT CUSHION AND COVER ASSEMBLY APPARATUS

BACKGROUND OF THE INVENTION

1. Field of the Invention

The invention pertains to apparatus for assembling compressible foam cushions having flexible covers wherein the cover is attached to the cushion while the cushion is in a partially compressed condition.

2. Description of the Related Art

Compressible foam seats and the like such as those widely used with automobiles and trucks consist of a resilient cushion encased within a flexible cower formed of fabric, vinyl, or the like. The cushion is usually semi-compressed when the cover is mounted thereon whereby the resiliency of the cushion will maintain the cover tight and stretched, and of an attractive appearance, and the semi-compression of the cushion aids in the weight supporting characteristics thereof.

A variety of devices have been proposed for aiding in the assembly of a compressible foam cushion and a cover. Many such devices are primarily manual requiring that the operator compress the cushion while simultaneously stretching the cover for attachment to the cushion bottom. Such manual assembly techniques require extensive manipulation by the operator often resulting in wrist and arm strain and injury, producing carpal tunnel and finger injuries, and the ergonomics of known devices leave much to be desired.

OBJECTS OF THE INVENTION

It is an object of the invention to provide assembly apparatus permitting a flexible cover to be assembled to a compressible foam cushion having excellent ergonomic characteristics substantially eliminating operator fatigue and injury.

An additional object of the invention is to provide assembly apparatus for compressible foam cushions having flexible covers wherein the compression of the cushion and positioning of the cover relative thereto prior to final assembly is mechanically achieved by power actuators and low exertion manual operations are only necessary during the final assembly stages.

A further object of the invention is to provide assembly apparatus for compressible foam cushions having flexible covers wherein the apparatus is readily adjustable for use with a variety of cushion and cover configurations permitting the apparatus to be utilized with a variety of cushion shapes.

Another object of the invention is to provide assembly apparatus for compressible cushions having flexible covers wherein the apparatus is highly versatile with respect to accommodating a variety of cushion configurations, the cushion being rotatable and indexable during the assembly process and the cover is sequentially assembled upon the cushion sides, and manual operations are minimized.

SUMMARY OF THE INVENTION

The assembly apparatus of the invention includes a vertically oriented frame having a vertical axis and lower and upper regions.

At its lower region, a shaft is rotatably mounted upon the frame coincident with the frame axis and supports a plate upon which the top and partially assembled cover of an inverted compressible foam cushion may be placed. A second shaft is supported on the upper region of the frame having a plate for engaging the inverted cushion bottom in opposed relationship to the lower plate, and an expansible chamber motor mounted on the frame raises and lower the upper plate to selectively compress and release the cushion.

A plurality of cover engaging rollers are located adjacent the lower plate, and in their lowered retracted position will be located below the cushion cover when the preliminarily assembled cushion and cover are placed upon the lower plate.

An expansible chamber motor selectively raises and lowers the cover engaging rollers whereby upon the cushion being compressed the rollers may be raised along selected sides of the cushion to lift the cover and pull the cover along the cushion sides permitting the upper portions of the cover to be fastened to the accessible cushion bottom.

The plates supporting the cushion are rotatable upon the associated frame, and a rotary actuator associated with the lower plate and shaft permits the compressed cushion to be rotated about the frame axis as desired. A brake and caliper device associated with the upper plate and shaft will retain the desired rotative positioning of the cushion, and in this manner the cushion may be selectively rotatably indexed as the cover engaging rollers sequentially stretch the cover over adjacent cushion sides to permit cover fastening.

In order to accommodate the Configuration of the cushion, the rollers are mounted upon guides transversely disposed to the frame axis and an expansible chamber motor permits rapid transverse adjustment of the rollers to assure that the rollers will be properly related to the cushion at each rotative cushion position.

The entire operation of the assembly, except for the fastening of the cover to the cushion bottom, is produced by motors minimizing the manual exertion required by the operator, and the apparatus permits a compressible foam cushion to be properly assembled to its cover in an ergonomic manner reducing the likelihood of operator injury.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
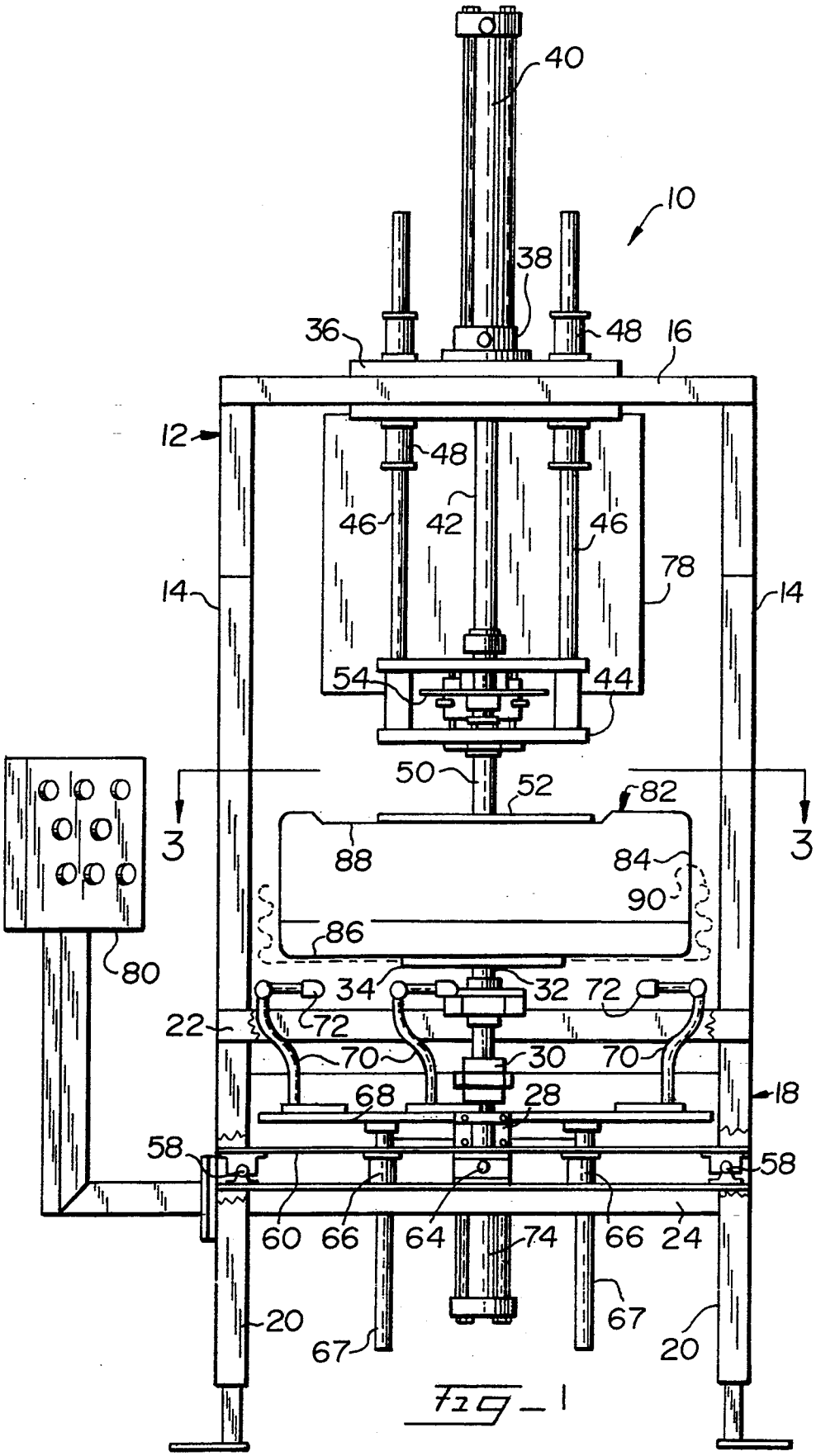
FIG. 1 is a front elevational view of assembly apparatus in accord with the invention, illustrating a foam cushion in a partially compressed condition, and the cover engaging rollers being retracted to their lowermost position.
Figure 2:
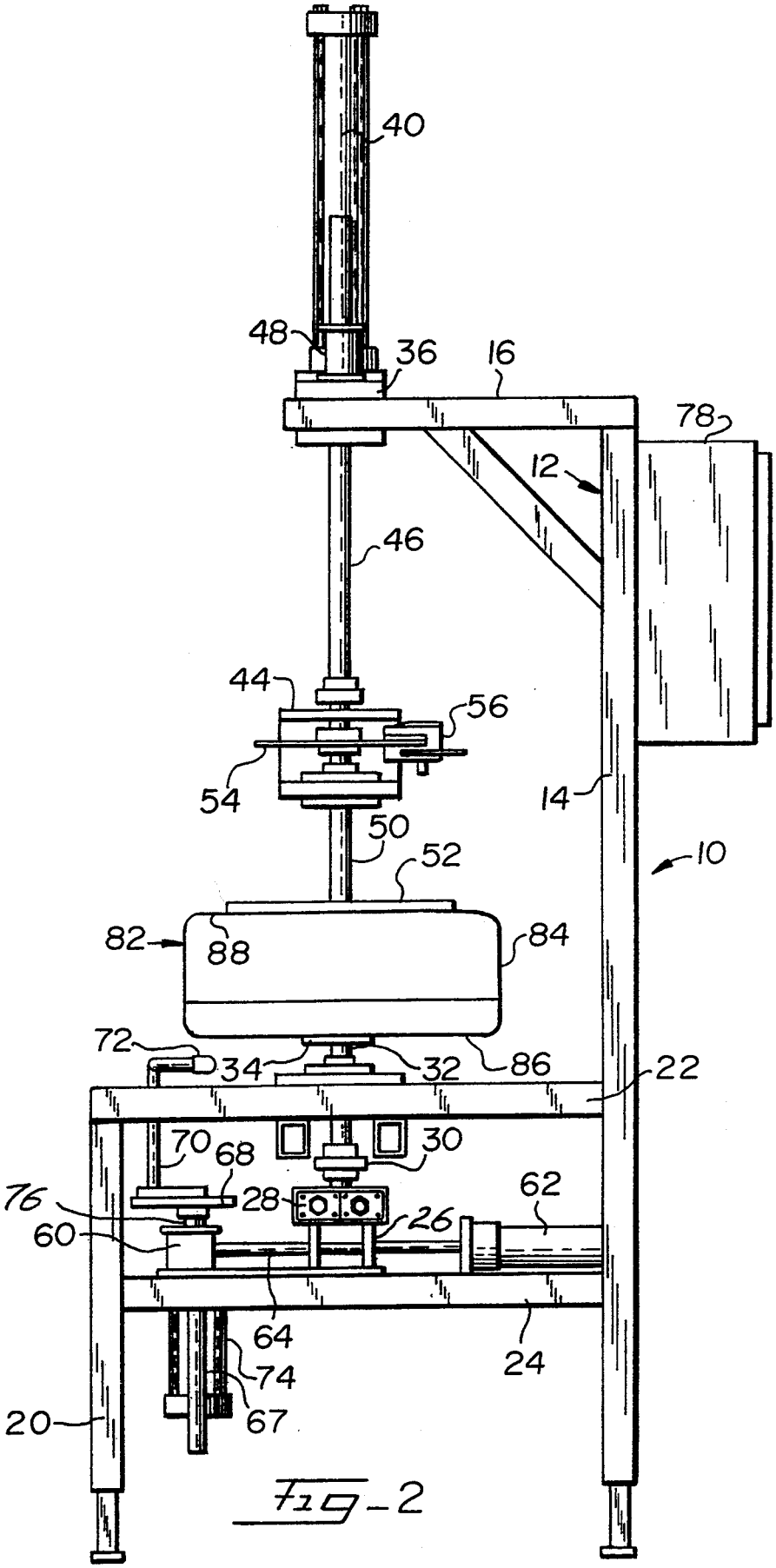
FIG. 2 is a side elevational view of the apparatus of FIG. 1 as taken from the right thereof.

As will be appreciated from FIGS. 1 and 2, a cushion and seat cover assembly apparatus in accord with the invention includes a frame 10 preferably oriented in a vertical manner having an upper region 12 defined by a pair of spaced columns 14 supporting a braced forward extending head platform 16. The frame 10 also includes a lower region 18 defined by the lower portion of the columns 14 and a pair of legs 20 attached to the columns by horizontal table elements 22. The table includes substructure rails 24, and telescoping adjustable extensions may be included within the lower ends of the columns 14 and legs 20 to adjust the vertical position of the frame 10 and produce a solid support for the frame.

A rotary actuator mount 26 is mounted upon the table substructure 24 and supports a rotary actuator 28, which may be operated by a pressurized medium, such as air or oil, to produce a rotary motion when energized. In a commercial version of the invention, the actuator 28 comprises a PHD rotary actuator Model R13R-6270-DAM.

The output shaft of the rotary actuator 28 extends upwardly and connects to a coupler 30 attached to the lower end of a shaft 32 rotatably mounted on the table elements 22. A seat supporting plate 34 is mounted upon the upper end of the shaft 32, and it will be appreciated that energizing of the actuator 28 will rotate the coupler 30, the shaft 32 and the lower cushion support plate 34 about the axis of shaft 32.

At the frame upper region 12, a head mounting plate 36 is supported on platform 16 which, in turn, supports the cylinder mounting collar 38. The collar 38 supports the expansible chamber motor 40 comprising a cylinder having an extendible and retractable piston 42. The axis of the cylinder 40, piston 42 and the shaft 32 is coincident, and this axis constitutes the longitudinal axis of the frame 10.

A bearing and brake holder 44 is located at the lower end of the piston 42, and is supported by the piston. The holder 44 includes a pair of spaced parallel shafts 46 slidably mounted within sleeve bearings 48 mounted upon the head mounting plates 36. Accordingly, as the piston 42 lowers during its extension, and raises during its retraction, the holder 44 will lower and raise in an accurate manner as guided upon the shafts 46 and bearings 48.

The holder 44 includes bearings in which the shaft 50 is rotatably mounted and extends below the holder 44. The lower end of the shaft 50 supports the cushion engaging plate 52, and the shaft 50 is coincident with the axis of the shaft 32 and piston 42.

As best shown in FIG. 2, the upper end of the shaft 50 has a brake disc 54 affixed thereto, and the opposite sides of the brake disc 54 are located within a brake caliper 56 having movable friction pads engageable with the opposite sides of the disc. Upon the brake pads being energized, the caliper 56 will frictionally grip the disc 54 and prevent rotation of the shaft 50 and plate 52.

A pair of parallel ways 58 are mounted upon the table rails 24 perpendicularly disposed to the frame axis, and the ways 58 support a stanchion mount 60 whereby the stanchion mount may be adjusted along the ways 58 by a linear motor consisting of expansible chamber cylinder 62 having a piston rod 64 extending therefrom. As the motor 62 is energized and the piston rod 64 extends and retracts, the stanchion mount 60 will be moved closer to, or further from, the axis of the shaft 32.

A pair of sleeve bearings 66 are mounted upon the stanchion mount 60 and slidably receive a pair of shafts 67 supporting a stanchion plate 68 at their upper end. A plurality of upstanding roller stanchions 70 are mounted upon the stanchion plate 68, and the stanchions 70 are so located as to correspond to the configuration of the cushion being assembled. Each of the stanchions 70 supports Teflon rollers 72 and the rollers 72 will rotate about axes perpendicular and offset from the frame longitudinal axis.

The stanchion plate 68, stanchions 70 and rollers 72 are raised and lowered by the expansible chamber motor cylinder 74 mounted upon the stanchion mount 60, and the motor 74 includes an extendable piston rod 76 attached at its upper ends to the stanchion plate 68. Accordingly, as the piston rod 76 extends and retracts, the stanchion plate 68, stanchions 70 and rollers 72 will raise and lower in a direction parallel to the frame axis.

A box 78 is mounted upon the rear side of the frame 10 wherein the electrical controls for the various actuators and motors are located, and a control box 80 mounted upon the frame 10 makes the control switches readily accessible to an operator standing adjacent the frame.

In operation, a compressible foam cushion 82 is inverted and supported upon the lower plate 34. The cushion 82 includes lateral sides 84, a top 86 and a bottom 88. The bottom 88 usually includes a tacking or fastening member incorporated into the cushion, not shown, adapted to receive fasteners for retaining the cover upon the cushion.

Figure 4:
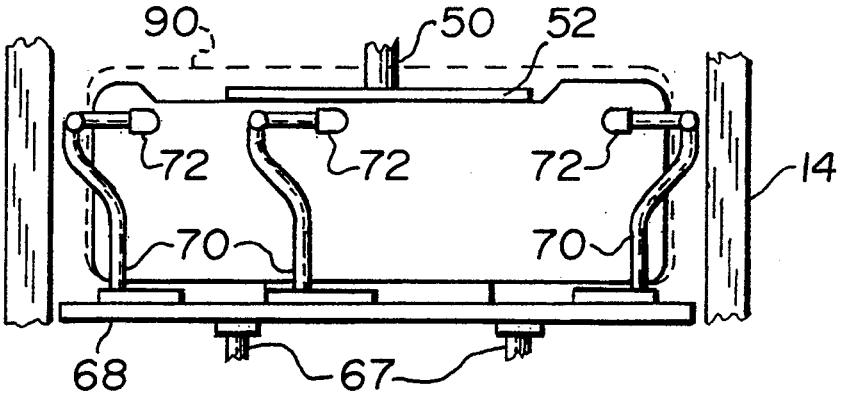
FIG. 4 is a detail elevational view illustrating the cover engaging rollers in an elevated position during stretching of the cover along the cushion sides.
Figure 3:
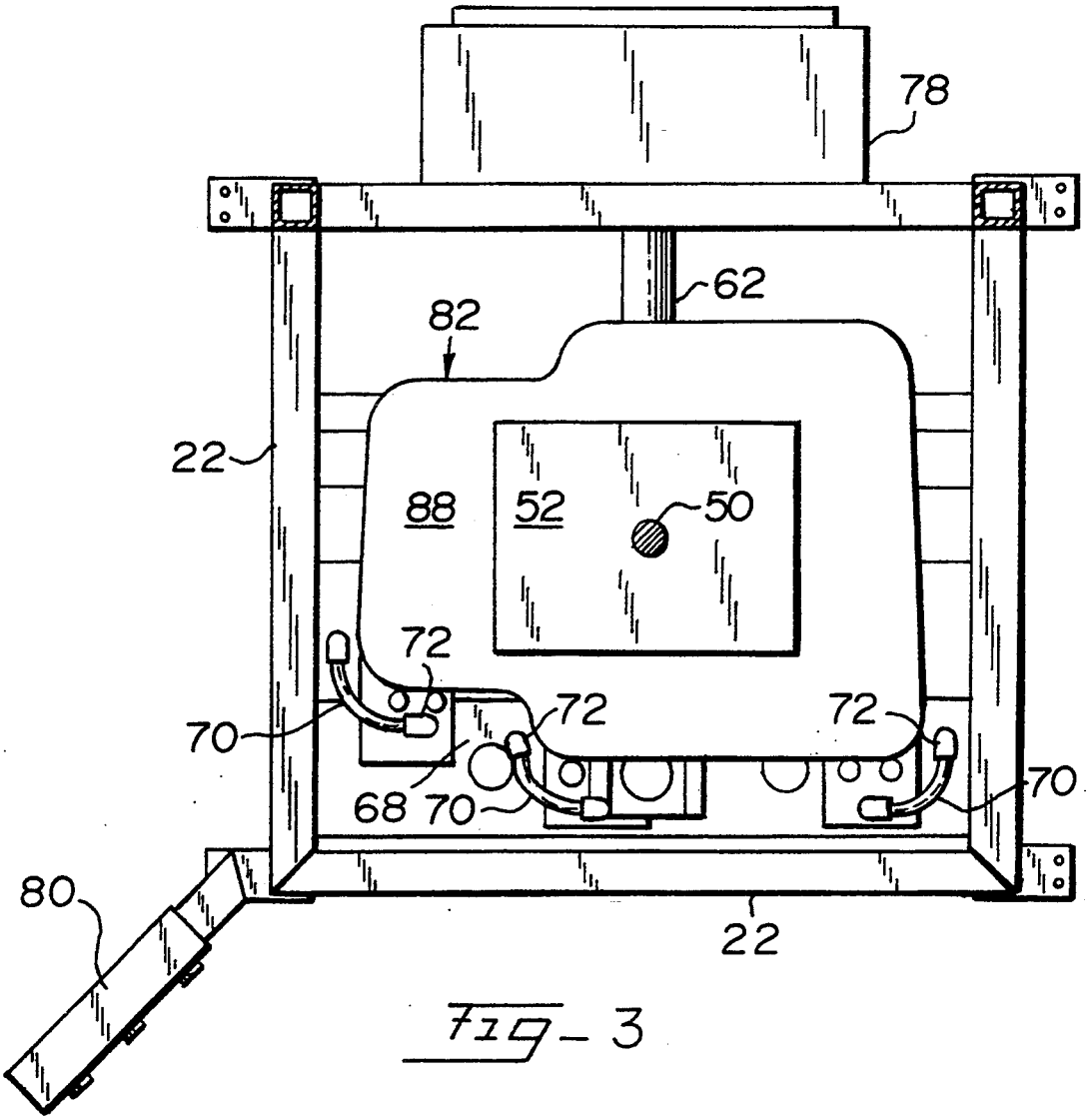
FIG. 3 is a plan sectional view as taken along Section 3—3 of FIG. 1.

In FIGS. 1 and 4, the cushion cover 90 is illustrated by dotted lines, and the cover 90 is of a flexible fabric or vinyl, or similar material, capable of closely conforming to the configuration of the cushion 82.

When the cushion 82 is inverted and placed upon the plate 32, the cover 90 will be preliminarily positioned over the cushion top 86 as to directly engage the plate 34. As indicated in FIG. 1, the flexible cover 90 will be folded and positioned above the stanchions 70 and rollers 72 in that the piston rod 76 will be retracted and the stanchions 70 will be in their lower position as shown in FIG. 1.

The cylinder 62 and piston rod 64 will have been previously adjusted so as to correctly position the stanchions 70 relative to the configuration of the cushion as originally oriented on the frame 10 and this programing of the positioning of the cylinder 62 may be pre-determined on a computer or a control within the box 78.

Upon the cushion 82 being properly placed upon the plate 34 by the operator, the cylinder 40 will be energized to lower or extend the piston 42 which lowers the holder 44, shaft 50 and plate 52. The plate 52 will engage the inverted cushion bottom 88, and the piston 42 will extend sufficiently to position the plate 34 to partially compress the cushion 82.

After the cushion 82 has been compressed to the desired extent, the cylinder 74 will be energized to extend and raise the piston rod 76, stanchion plate 68, stanchions 70, and rollers 72. This upward movement of the rollers 72 to the position shown in FIG. 4 will raise that portion of the cushion cover 90 disposed over the rollers 72 drawing the cover closely along the cushion sides 84 such that the cover will snugly engage the cushion sides 84 and be snugly drawn across the cushion top 86 due to the upward movement of the rollers 72. Upon the rollers 72 being raised to the maximum extent, the top free portion of the cover 90, as illustrated in FIG. 4, may be pulled over the edge of the cushion, and fasteners inserted through the cover 90 into the fastener receiving structure located upon the cushion bottom 88. In this manner, that portion of the cushion cover 90 engaged by the rollers 72 will be assembled to the cushion as desired.

After the stretched portions of the cover has been fastened to the cushion bottom 88, the cylinder 74 is energized to retract the piston rod 76 and lower the stanchion plate 68, stanchions 70 and rollers 72 to the position shown in FIG. 1. Thereupon, the caliper brake 56 is released and the rotary actuator 28 is energized to rotatably index the shaft 32 and plate 34, and the compressed cushion 82. The rotary actuator 28 will rotate the plate 34 and cushion 82 to a new orientation of the rollers 72 to sides 84 of the cushion 82 over which the cover has not been drawn. Upon the proper rotation of the cushion occurring, as determined by the rotary actuator 28 and associated feedback, the brake caliper 56 will be energized to prevent further rotation of the shaft 50 and cushion 82, and the cylinder 74 will again be energized to extend and raise the piston rod 76 causing the rollers 72 to lift the portion of the cushion cover 90 disposed thereover and the roller 72 will be raised to the position of FIG. 4 again drawing the cushion cover snugly adjacent the cushion sides 84 and permitting the cover to be fastened to the cushion bottom 88.

Depending on the configuration of the cushion 82, only two cycles as above described may be necessary to completely attach the cover 90 to the cushion 82. If desired, additional cycles may be employed and repeated as described above.

The ability of the stanchion mount 60 to be transversely adjusted relative to the frame axis by the cylinder 62 and piston rod 64 permits the rollers 72 to be adjusted as necessary between cycles to accommodate the cushion configuration, and it will be appreciated that the assembly apparatus in accord with the invention is highly versatile and may be readily adjusted and set up to accommodate a variety of cushion configurations. Merely by relocating the stanchions 70 upon the stanchion plate 68, by bolts, the rollers 72 may be positioned as desired, and the transverse adjustability of the stanchion mount 60 permits roller variation and positioning to be quickly achieved.

The degree of rotation of the cushion 82 as produced by the rotary actuator 28 may be accurately regulated, and the indexing and holding of the position of the cushion 82 by the brake disc 54 and caliper 56 assures proper orientation of the rollers 72 to the cushion during each cycle.

After the cover 90 has been fully attached to the bottom 88 of the cushion 82, the cylinder 40 is energized to retract the piston 42, raising the holder 44, shaft 50 and upper plate 52. The operator may then pick the assembled cushion and cover from the lower plate 34, and place the next cushion and partially assembled cover on the plate 34. The operating cycle is again repeated as described above.

Because the apparatus of the disclosed assembly device uses powered motors and actuators to compress the cushion, tension the cover over the cushion, and position the cover rollers, the assembly apparatus is ergonomically advantageous, and manual exertion, and the opportunity for injury, are minimized.

It is appreciated that various modifications to the inventive concepts may be apparent to those skilled in the art without departing from the spirit and scope of the invention.

I claim:

1. A cushion and cover assembly apparatus for assembling a flexible cover upon a compressible foam cushion having sides, a top, a bottom and a fastener receiving member incorporated into the cushion adjacent the cushion bottom comprising, in combination, a frame having a longitudinal axis, a first plate for engaging the cushion top mounted on said frame, a second plate for engaging the cushion bottom mounted on said frame, said plates being in spaced opposed relationship for receiving a cushion therebetween having a flexible cover preliminarily positioned adjacent the cushion top, cushion compression means mounted on said frame operatively associated with at least one of said plates for selectively displacing the associated plate in the axial direction of said frame to compress the cushion, cover engaging and displacing means mounted on said frame adjacent said first plate adapted to engage the cushion cover and selectively translate the cushion cover along the cushion sides toward the cushion bottom in a direction substantially parallel to the frame axis, a cover engaging and displacing means actuator mounted on said frame operatively connected to said cover engaging and displacing means displaceable between cover displacement and retracted positions, and control means operating said cushion compression means and said actuator.

2. In a cushion and cover assembly apparatus as in claim 1, adjustment means mounting said cover engaging and displacing means on said frame for movement transverse to said frame axis to permit said cover engaging and displacing means to be laterally adjusted to accommodate variations in cushion configuration.

3. In a cushion and cover assembly apparatus as in claim 2, adjustment motor means mounted on said frame selectively adjusting said adjustment means, and control means for operating said adjustment motor means.

4. In a cushion and cover assembly apparatus as in claim 3, said adjustment motor means comprising an expansible chamber motor.

5. In a cushion and cover assembly apparatus as in claim 1, said cover engaging and displacing means comprising rollers having an axis of rotation transversely related to the frame axis.

6. In a cushion and cover assembly apparatus as in claim 1, wherein said cushion compression means comprises a linear motor.

7. In a cushion and cover assembly apparatus as in claim 6, said linear motor comprising an expansible chamber motor.

8. In a cushion and cover assembly apparatus as in claim 1, rotative means supporting said first and second plates for rotation about coincident axes substantially parallel to said frame axis, a rotation actuator operatively associated with one of said plates for rotating said plates simultaneously upon a cushion being compressed therebetween, and a selectively releasable brake operatively associated with one of said plates for restraining said plates against rotation.

9. A cushion and cover assembly apparatus for assembling a flexible cover upon a compressible foam cushion having sides, a top, a bottom and a fastener receiving member incorporated into the cushion adjacent the cushion bottom comprising, in combination, a frame having a vertical axis, an upper region and a lower region, a first shaft rotatably mounted on said frame lower region having a vertically oriented axis coincident with said frame axis, a first plate mounted upon said first shaft adapted to support the top of an inverted foam cushion having a cover preliminarily positioned thereon, a second shaft rotatably mounted on said frame upper region having a vertically oriented axis coincident with said first shaft axis, a second plate mounted on said second shaft in vertically opposed relation to said first plate adapted to engage the bottom of an inverted foam cushion supported on said first plate, a second shaft linear motor mounted on said frame upper region operatively connected to said second shaft to selectively axially translate said second shaft and said second plate between a raised retracted position and a lowered cushion compression position, cushion cover engaging and displacing means movably mounted on said frame lower region adjacent said first plate vertically movable between a lowered retracted position and a raised cover lifting position locating the cushion cover adjacent the cushion sides upon the cushion being compressed between said plates, a cover engaging and displacing means actuator mounted on said frame lower region selectively moving said means between said lower and raised positions, and controls mounted on said frame controlling said linear motor and said actuator.

10. In a cushion and cover assembly apparatus as in claim 9, adjustment means mounting said cover engaging and displacing means on said frame for movement transverse to said frame axis to permit said cover engaging and displacing means to be laterally adjusted to accommodate variations in cushion configuration.

11. In a cushion and cover assembly apparatus as in claim 10, adjustment motor means mounted on said frame lower region selectively adjusting said adjustment means, control means mounted on said frame for operating said adjustment motor means.

12. In a cushion and cover assembly apparatus as in claim 11, said adjustment motor means comprising an expansible chamber motor.

13. In a cushion and cover assembly apparatus as in claim 9, said cover engaging and displacing means comprising rollers having an axis of rotation transversely related to the frame axis.

14. In a cushion and cover assembly apparatus as in claim 9, said second shaft linear motor and said cover engaging and displacing means actuator each comprising expansible chamber motors.

15. In a cushion and cover assembly apparatus as in claim 9, a rotative motor operatively connected to said first shaft for selectively rotatably indexing said first shaft and said first plate and said second plate and said second shaft upon a cushion being compressed between said plates, and a brake operatively associated with one of said shafts to retain said shafts in the desired rotative position.

16. In a cushion and cover assembly apparatus as in claim 15, said brake comprising a disc coaxially mounted on said second shaft and a non-rotative clamp adapted to selectively clamp said disc to prevent rotation of said second shaft.

* * * * *